United States Patent [19]

Tyler et al.

[11] Patent Number: 4,459,450

[45] Date of Patent: Jul. 10, 1984

[54] METHOD OF REDUCING POLLUTION IN MICROWAVE DEVULCANIZATION PROCESS

[75] Inventors: Keith A. Tyler; Gene L. Cerny, both of Lincoln, Nebr.

[73] Assignee: The Goodyear Tire & Rubber Company, Akron, Ohio

[21] Appl. No.: 426,042

[22] Filed: Sep. 28, 1982

[51] Int. Cl.[3] ..... H05B 6/78

[52] U.S. Cl. ..... 219/10.55 M; 219/10.55 R; 219/10.55 A; 264/174

[58] Field of Search ..... 219/10.55 R, 10.55 A, 219/10.55 M; 264/174, 176 R, 216, 25, 26

[56] References Cited

U.S. PATENT DOCUMENTS

| | | | |
|---|---|---|---|
| 3,993,723 | 11/1976 | Davis et al. | 264/178 R |
| 4,104,205 | 8/1978 | Novotny et al. | 204/159.17 |
| 4,107,354 | 8/1978 | Wilkenloh et al. | 264/174 |
| 4,123,584 | 10/1978 | Brewton | 264/174 |
| 4,129,768 | 12/1978 | Anderson | 219/10.55 M |
| 4,130,616 | 12/1978 | Clifford | 264/178 R |

*Primary Examiner*—Roy N. Envall, Jr.
*Assistant Examiner*—M. M. Lateef
*Attorney, Agent, or Firm*—J. D. Wolfe; R. D. Thompson

[57] ABSTRACT

This invention provides a method of controlling the pollution in a microwave devulcanization process consisting of passing particles of sulfur-vulcanized elastomer containing polar groups through a microwave energy devulcanization device to generate heat in the devulcanization of said particles whereby said particles exits said device at a temperature in excess of 260° C., feeding said particles from the devulcanization device to feed input of an extruder, extruding said particles to exit the extruder at a temperature of about 90° to 125° C. as an extrudate. The extrudate can be used per se as a compounding stock or sent to a mill to be sheeted and stored until needed.

2 Claims, 1 Drawing Figure

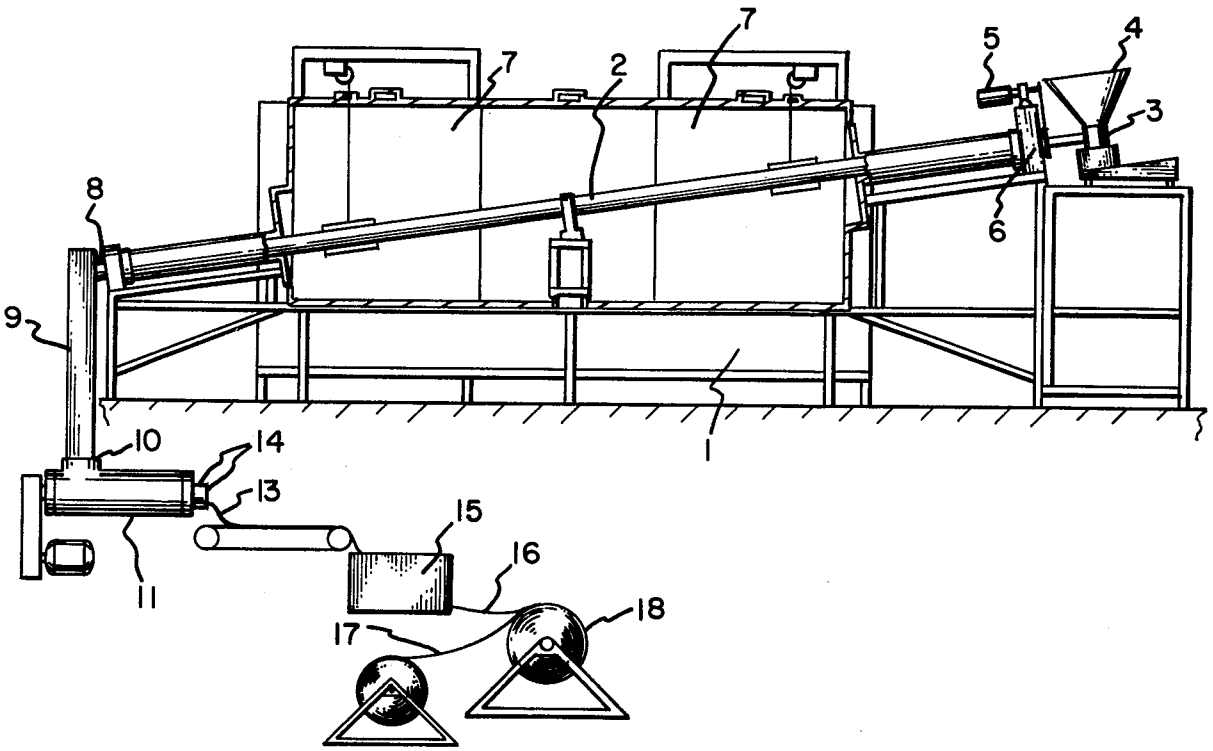
1
2
3
4
5
6
7
7
8
9
10
11
13
14
15
16
17
18

METHOD OF REDUCING POLLUTION IN MICROWAVE DEVULCANIZATION PROCESS

TECHNICAL FIELD

This invention relates to a method of reducing pollution in a microwave devulcanization process. More particularly this invention relates to a process for devulcanization of a sulfur vulcanized elastomer comprising subjecting particles of said sulfur vulcanized elastomer containing polar group to sufficient microwave energy to generate a temperature of at least 260° C. in said particles, feeding said devulcanized particles to feed of an extruder and extruding said devulcanized particles as an extrudate having a temperature of about 90° to 125° C.

BACKGROUND

It has been known that sulfur vulcanized elastomers containing polar groups can be devulcanized with microwave energy as shown by the following U.S. Pat. Nos. 4,104,205 to Novotny, et al, 4,129,768 to Anderson, and 3,777,095 to Muranaka. These patents describe the operating parameters and equipment to which this invention is applicable and useful for devulcanization step. In commercial practice it has been learned that use of powdery partitioning agent, such as powdery silica to coat the particles and a fused quartz tube gives improved results and longer life to the tube.

Unfortunately, the devulcanized particles have relatively large amounts of fines and give off offensive fumes or vapors. Further, the temperature of the devulcanized material as it leaves the microwave devulcanizer is very high, usually in excess of 250° C. and sometimes even in excess of 350° C. and thus problems are experienced in handling and storing the devulcanized material. For instance, the hot particles from the devulcanizer can destroy a belt conveyor in a relatively short time and fills the air with carbon black fines and fumes.

SUMMARY OF THE INVENTION

According to this invention an improved method for controlling the pollution in a microwave devulcanization process is obtained by the steps consisting of passing particles of sulfur-vulcanized elastomer containing polar groups through a microwave energy devulcanization device which generates heat in the devulcanization of said particles whereby said particles exists said device at a temperature in excess of 260° C., feeding said particles from the devulcanization device to a feed input of an extruder, extruding said particles to exit the extruder at a temperature of about 90° to 125° C. as an extrudate operations according to the above process gives a devulcanized product or extrudate that does not fill the air with fumes or fines such as carbon black, but exhibits improved yields up to about 15% by weight in some cases. Further the extrudate of this invention exhibits improved physical properties as the fines are included in the extrudate. Hence, the better results are generally obtained when the extruder has a screw length to diameter ratio of about 3.5–4.5 to 1.

BRIEF DESCRIPTION OF THE DRAWINGS

The FIGURE of the drawing is a schematic view of the apparatus wherein the numeral 1 designates a microwave oven provided with rotatable microwave transparent tube 2, preferably of fused quartz. The upper end 3 of the tube is fitted with a feed funnel 4 through which the particles of sulfur vulcanized elastomer containing polar groups are charged to the microwave oven. The motor 5 and rotation means 6, suitable gear or chains, turns the tube 2 to cause the particles to move downward pass the microwave energy zone or zones 7 to the exit 8. The particles drop out the tube at exit 8, at a temperature in excess of 260° C. and sometimes up to 380° C. and falls through chute 9 into the feed hopper 10 to the extruder 11. The extruder 11 is of the conventional type having a screw or screws (not shown) to move the devulcanized product from the feed hopper through the extruder and form it into the extrudate 13 coming from the die 14 of the extruder. The devulcanized elastomer has its temperature adjusted to about 90° to 125° C. preferably by use of cooling water in the extruder. The extrudate as a ribbon or strip passes through a refining mill 15 to be formed into a sheet 16. This sheet with a separator cloth 17 is rolled into a roll 18 to be stored until it is used.

EXAMPLE 1

Scrap elastomers such as EPDM hose end trim and butyl tire bladders was grounded to pass a 0.95 centimeter screen and was charged at 100 parts by weight per minute to the hopper 4 of the transport tube alone with 0.5 to 3 parts finely divided powdery silica, as a partitioning agent. The devulcanized particles at about 355° C. pass from the devulcanizer 1 to the extruder 11. The extrudate passes from the extruder at about 125° C. and is relatively free of fumes and fines. The extrudate was sheeted in the refining mill and rolled into a roll to await use. This extrudate was obtained in better yield and had superior physical properties to the devulcanized material which had not passed through the extruder.

While certain representative embodiments and details have been shown for the purpose of illustrating the invention, it will be apparent to those skilled in this art that various changes and modifications may be made therein without departing from the scope of the invention.

We claim:

1. A method of controlling the pollution in a microwave devulcanization process consisting of passing particles of sulfur-vulcanized elastomer containing polar groups through a microwave energy devulcanization device which generates heat in the devulcanization of said particles whereby said particles exits said device at a temperature in excess of 260° C., feeding said particles from the devulcanization device to a feed input of an extruder, extruding said particles to exit the extruder at a temperature of about 90° to 125° C. as an extrudate.

2. The method of claim 1 wherein the extruder has a screw with the ratio of length of screw to its diameter being about 3.5–4.5 to 1.

* * * * *